US006638391B1

(12) United States Patent
Hsu et al.

(10) Patent No.: US 6,638,391 B1
(45) Date of Patent: Oct. 28, 2003

(54) WAFER CARRIER ASSEMBLY FOR A CHEMICAL MECHANICAL POLISHING APPARATUS AND A POLISHING METHOD USING THE SAME

(75) Inventors: Chia-Lin Hsu, Taipei (TW); Art Yu, Kaoshiung (TW); Shih-Hsun Hsu, Keelung (TW); Hsueh-Chung Chen, Yung-Ho (TW)

(73) Assignee: United Microelectronics Corp., Hsin-Chu ( * ) Notice: Subject to any disclaimer, the term of this patent is extended or adjusted under 35 U.S.C. 154(b) by 0 days.

(21) Appl. No.: 10/177,306

(22) Filed: Jun. 19, 2002

(51) Int. Cl.[7] ..... H01L 21/302
(52) U.S. Cl. ..... 156/345.12; 269/21
(58) Field of Search ..... 269/21; 156/345.12, 156/345.14; 118/728, 500, 503; 451/365

(56) References Cited

U.S. PATENT DOCUMENTS 5,958,794 A * 9/1999 Bruxvoort et al. ..... 438/692

6,296,557 B1 * 10/2001 Walker ..... 451/526

* cited by examiner

*Primary Examiner*—Gregory Mills
*Assistant Examiner*—Sylvia R. MacArthur
(74) *Attorney, Agent, or Firm*—Merchant & Gould P.C.

(57) ABSTRACT

A wafer carrier assembly for a chemical mechanical polishing apparatus and a polishing method using the same are provided. The present wafer carrier assembly comprises a first plate, a second plate and a flexible membrane. The first plate has a plurality of protrusions formed on a bottom surface thereof and the second plate has a plurality of apertures passing through. Each of the protrusions is matched with one of the apertures to enable the first plate and the second plate to detachably combine together. The flexible membrane is positioned under the second plate and contacts it. A surface of the flexible membrane opposite to the surface of the flexible membrane contacting the second plate provides a wafer-receiving surface.

14 Claims, 4 Drawing Sheets

WAFER CARRIER ASSEMBLY FOR A CHEMICAL MECHANICAL POLISHING APPARATUS AND A POLISHING METHOD USING THE SAME

BACKGROUND OF THE INVENTION

1. Field of the Invention

The present invention relates to the field of semiconductor manufacturing and, more specifically, to an improved method and apparatus for a wafer carrier for chemical mechanical planarization usage.

2. Description of the Prior Art

The present invention relates to the technology of polishing or planarizing semiconductor surfaces including substrate surfaces during or after the process of processing these surfaces. The creation of semiconductor surfaces typically includes the creation of active devices in the surface of the substrates, the polishing of semiconductor surfaces can occur at any time within the sequence of processing semiconductors where such an operation of polishing is beneficial or deemed necessary.

That good surface planarity during the creation of semiconductor devices is of prime importance in achieving satisfactory product yield and in maintaining target product costs is readily evident in light of the fact that a semiconductor device typically contains a multiplicity of layers that form a structure of one or more layers superimposed over one or more layers. Any layer within that structure that does not have good planarity leads to problems of increased severity for the overlying layers. Most of the processing steps that are performed in creating a semiconductor device involve steps of photolithography that critically depend on being able to sharply define device features, a requirement that becomes increasingly more important where device features are in the sub-micron range or even smaller, down to about 0.1 $\mu$m. Planarity directly affects the impact that light has on the surface of for instance a layer of photoresist, a layer that is typically used for patterning and etching the various layers that make up a semiconductor device. Lack of planarity leads to light diffusion which leads to poor depth of focus and a limitation on feature resolution, i.e. features such as adjacent lines cannot be closely spaced, a key requirement in today's manufacturing environment.

Chemical mechanical polishing (CMP) is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. In order to attain optimum planarization of a semiconductor surface, it is very important to control polishing uniformity on the semiconductor surface. A wafer carrier for loading/unloading a semiconductor wafer to be polished unto a polishing platen in a chemical mechanical polishing apparatus gives crucial influence on polishing uniformity.

FIG. 1 shows a cross-sectional view of a prior wafer carrier 1, which comprises a stainless steel plate 10 and a supporting film 12. A plurality of through-holes 14 are formed in the stainless steel plate 10. The supporting film 12 is attached on a bottom surface of the stainless steel plate 10 serving for a cushion. And, a semiconductor wafer 16 is received beneath the bottom surface of the stainless steel plate 10. When loading the semiconductor wafer 16, the through-holes 14 are evacuated so as to soak the semiconductor wafer 16 on the supporting film 12, as shown in FIG. 1. However, due to the material of the stainless steel plate 10 and the locally through-holes 14, both of local uniformity and global uniformity on the polishing surface 18 of the semiconductor wafer 16 can not be properly controlled.

A prior membrane type wafer carrier 2 is therefore provided, as shown in FIG. 2. The prior membrane type wafer carrier 2 comprises a stainless steel plate 20, a flexible membrane 22 and a supporting film 24. A plurality of through-holes 26 are formed in the stainless steel plate 20. The supporting film 24 is attached on a bottom surface of the stainless steel plate 20. The flexible membrane 22 is positioned under the supporting film 24. A first surface of the flexible membrane 22 contacts the supporting film 24 and a second surface of the flexible membrane 22 opposite the first surface provides a wafer-receiving surface. FIG. 3 is a bottom plane view of the stainless steel plate 20. When loading a semiconductor wafer 28, the through-holes 26 are evacuated and thus form a plurality of vacuum spaces on the second surface of the flexible membrane 22 to soak the semiconductor wafer 28. Since the flexibility of the flexible membrane 22, the global uniformity on the polishing surface of the semiconductor surface 28 can be improved during the polishing process. However, the through-holes 26 still provide adversely influence for local uniformity of the polishing surface of the semiconductor wafer 28.

Accordingly, it is desirable to have an improvement on a wafer carrier structure of a chemical mechanical polishing apparatus to mitigate the issues of global uniformity and local uniformity for a chemical mechanical polishing process.

SUMMARY OF THE INVENTION

It is an objective of the present invention to provide a wafer carrier assembly for a chemical mechanical polishing apparatus, which can provide global uniformity and local uniformity for a semiconductor wafer during a chemical mechanical polishing process.

It is another objective of the present invention to provide a wafer carrier assembly for a chemical mechanical polishing apparatus, which is provided with a wafer carrier including a first plate and a second plate. By way of separating the first plate and the second plate and turning on a vacuum there-between to provide vacuum-chucking for a semiconductor wafer for loading it, and recombining the first plate and the second plate during a polishing process so as to provide local uniformity for the semiconductor wafer.

It is a further objective of the present invention to provide a wafer carrier assembly for a chemical mechanical polishing apparatus, which is provided with a flexible membrane positioned under a wafer carrier of the wafer carrier assembly to provide global uniformity for a semiconductor wafer during a polishing process.

It is still a further objective of the present invention to provide a method for chemical mechanical polishing a semiconductor wafer, which can improve global uniformity and local uniformity for the semiconductor wafer.

In order to achieve the above objectives, the present invention provides a wafer carrier assembly for a chemical mechanical polishing apparatus and a polishing method for the same. The present wafer carrier assembly comprises a first plate, a second plate and a flexible membrane. A plurality of protrusions are formed on a bottom surface of the first plate and a plurality of apertures pass through the second plate. Each of the protrusions is matched with one of the apertures such that the first plate and the second plate can detachably combine together. The flexible membrane is positioned under the second plate. A first surface of the flexible membrane contacts a bottom surface of the second plate and a second surface of the flexible membrane opposite the first surface provides a wafer-receiving surface. When loading a semiconductor wafer, the first plate is separated from the second plate and a vacuum is turn on there-between, thus a plurality of vacuum spaces are formed under the second surface of the flexible membrane beneath the apertures of the second plate to provide vacuum-chucking for a semiconductor wafer. During polishing the semiconductor wafer, the first plate and the second plate are recombined together to form a flat plate so that there is not any evacuated opening existing therein to adversely influence local uniformity of the semiconductor wafer. Besides, the flexible membrane improves global uniformity of the semiconductor wafer.

BRIEF DESCRIPTION OF THE DRAWINGS

The present invention can be best understood through the following description and accompanying drawings, wherein.

DESCRIPTION OF THE PREFERRED EMBODIMENTS

The present invention provides a wafer carrier assembly for a chemical mechanical polishing apparatus and a polishing method for the same. The present wafer carrier assembly includes a first plate, a second plate and a flexible membrane. The first plate has a plurality of protrusions formed on a backside thereof contacting the second plate. A plurality of apertures pass through the second plate and each of the apertures is matched with one of the protrusions so as to make the first plate and the second plate detachably combine together. The flexible membrane is positioned under the second plate. A first surface of the flexible membrane contacts the second plate and a second surface of the flexible membrane opposite to the first surface provides a wafer-receiving surface. When loading a semiconductor wafer, the first plate is separated from the second plate and turn on a vacuum there-between, the apertures of the second plate are thus evacuated, generating a plurality of vacuum spaces on the second surface of the flexible membrane to soak the semiconductor wafer. The present wafer carrier assembly then moves unto a polishing platen, placing the semiconductor wafer on the polishing platen. When polishing the semiconductor wafer, the vacuum between the first plate and the second plate is released, and the first plate and the second plate recombine together to form a flat plate without apertures passing through. Since the flexibility of the flexible membrane and the flat plate consisting of the first plate and the second plate without through-holes existing therein during the polishing process, global uniformity and local uniformity on a polishing surface of the semiconductor wafer can be control quite well. The present wafer carrier assembly and the present polishing method can also be applied to chemical mechanical polishing processes for a semiconductor substrate, a disk and glass and the like.

Figure 1:
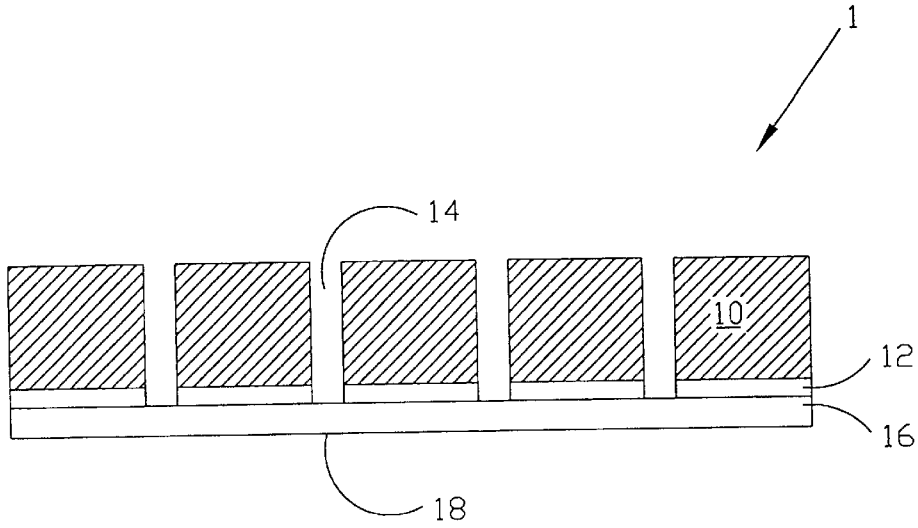
FIG.1(Prior Art)
FIG. 1 is a cross-sectional view of a prior wafer carrier.
Figure 2:
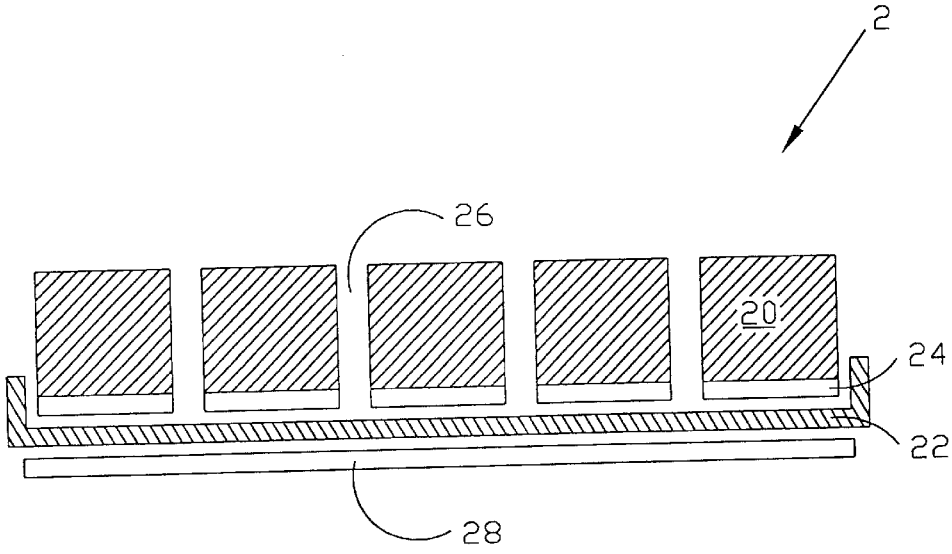
FIG.2(Prior Art)
FIG. 2 is a cross-sectional view of a prior membrane type wafer carrier.
Figure 3:
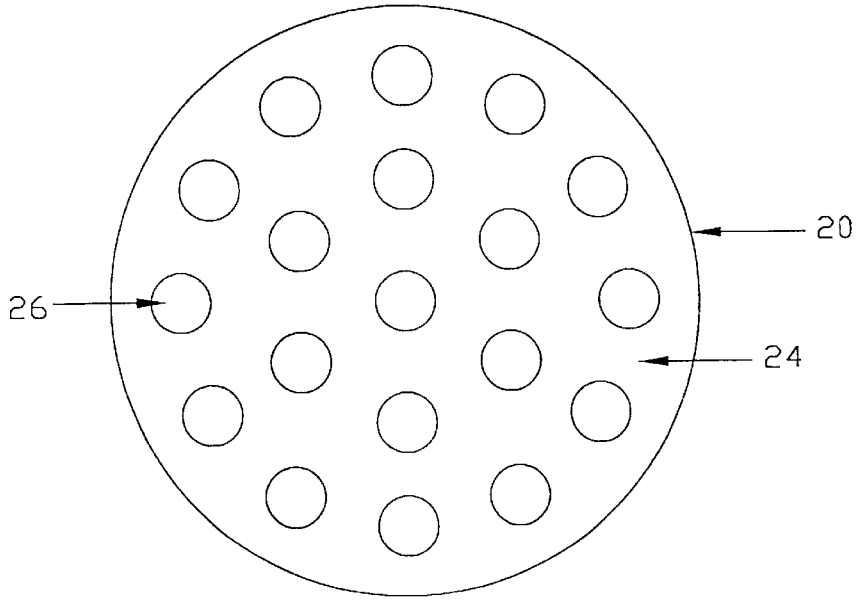
FIG.3(Prior Art)
FIG. 3 is a bottom plane view of a stainless steel plate of the prior membrane type wafer carrier of FIG. 2.
Figure 4:
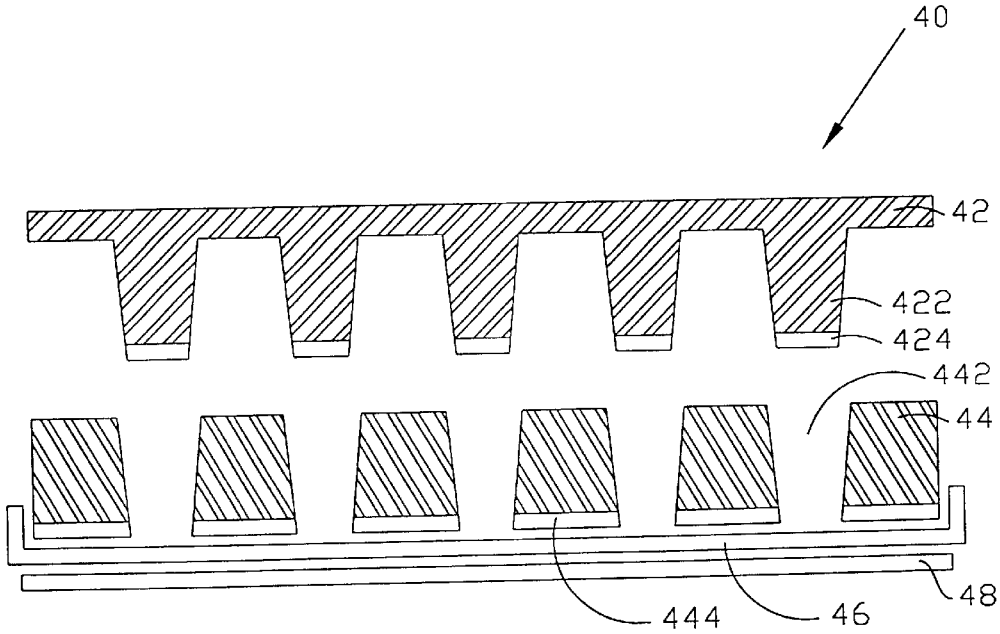
FIG. 4 is a cross-sectional view of a wafer carrier assembly according to one preferred embodiment of the present invention, in which a first plate and a second plate are separated from each other.
Figure 5:
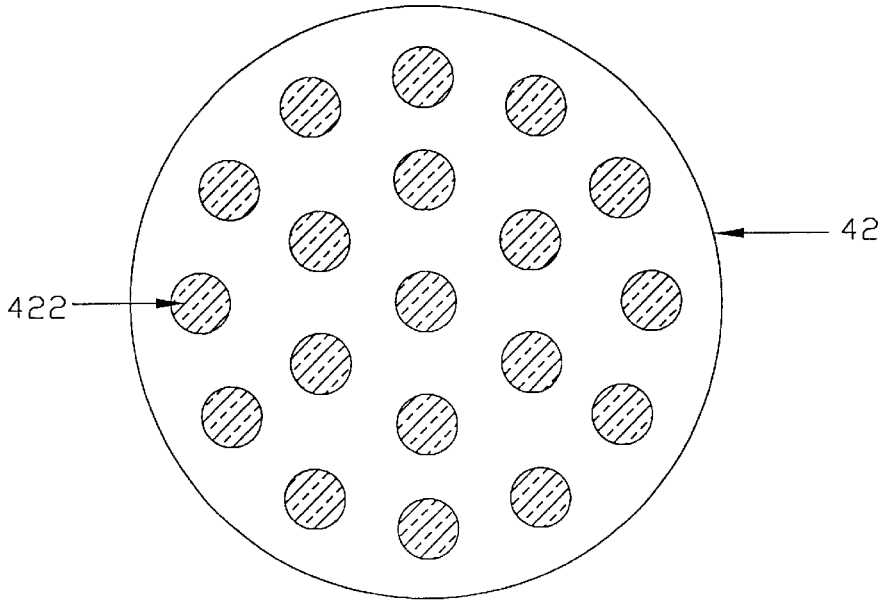
FIG. 5 is a bottom plane view of the first plate of the wafer carrier assembly according to the preferred embodiment of the present invention.
Figure 6:
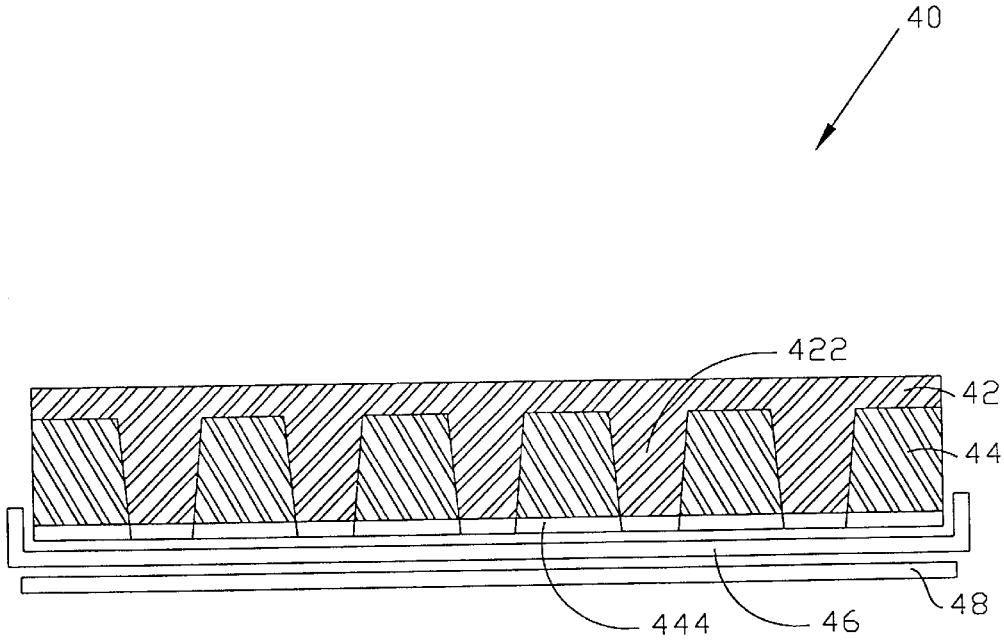
FIG. 6 is a cross-sectional view of a wafer carrier assembly according to the preferred embodiment of the present invention, in which the first plate and the second plate are combined together.

FIG. 4 to FIG. 6 illustrates a preferred embodiment of the present wafer carrier assembly. As shown in FIG. 4 and FIG. 6, the present wafer carrier assembly 40 comprises a first plate 42, a second plate 44, a first supporting film 424, a second supporting film 444 and a flexible membrane 46. The first plate 42 has a plurality of protrusions 422, for example nipple-shaped protrusions, formed on a bottom surface thereof, i.e. the backside thereof, such that the first plate 42 is provided with a wedge-shaped backside contacting the second plate 44. FIG. 5 shows a bottom plane view of the first plate 42 with a wedge-shaped backside. A plurality of apertures 442 pass through the second plate 44, and each of the apertures 442 is matched with one of the protrusions 422, enabling the first plate 42 and the second plate 44 to detachably combine together. The first supporting film 424 is attached unto a surface facing downward of each of the protrusions 422 for serving as a cushion. The second supporting film 444 is attached unto a bottom surface of the second plate 44 contacting the flexible membrane 46 for serving as a cushion. Both of the first plate 42 and the second plate 44 can be formed with a circular shape, namely like a wafer shape, and formed of stainless steel or any hard material having a hardness at least about 30RB. The first plate 42 can also be integrally formed with the protrusions 422. The flexible membrane 46 can be formed with U shape, and is positioned under the second plate 44. A first surface of the flexible membrane 46 contacts the second supporting film 444, and a second surface of the flexible membrane 46 opposite to the first surface provides a wafer-receiving surface.

Figure 7:
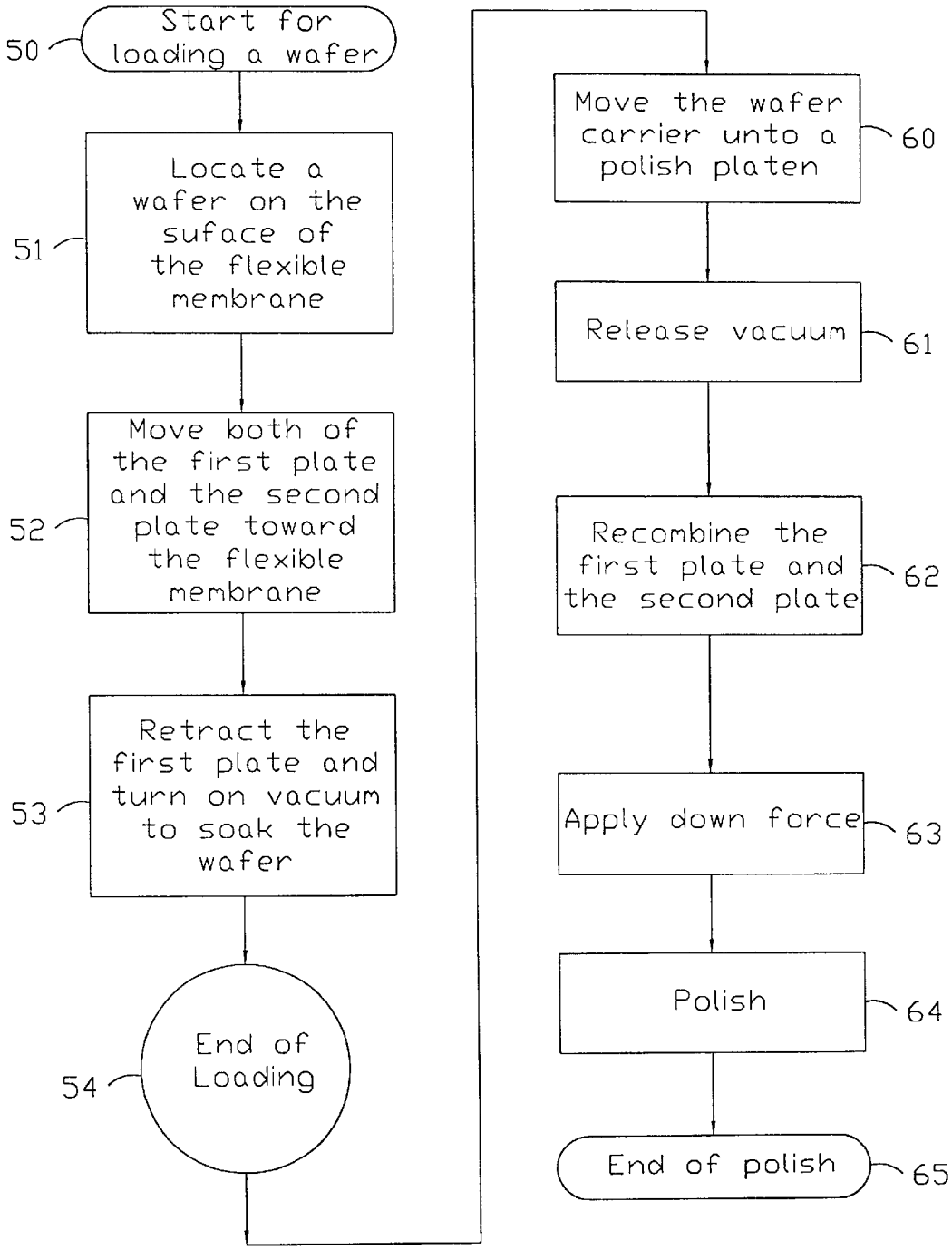
FIG. 7 is a flow diagram of an example utilizing the present wafer carrier assembly in a chemical mechanical polishing process.

FIG. 7 is a flow diagram of an example utilizing the present wafer carrier assembly 40 in a chemical mechanical polishing process, in which step 50 to step 54 represent a process for loading a semiconductor wafer 48 with the present wafer carrier assembly 40, and step 60 to step 65 represent a process for polishing the semiconductor wafer 48.

In operation of the present wafer carrier assembly 40 for loading the semiconductor wafer 48, as illustrated in step 50 to step 54, firstly, the semiconductor wafer 48 is placed on the second surface of the flexible membrane 46, i.e. the wafer-receiving surface, moving both of the first plate 42 and the second plate 44 toward the flexible membrane 46. Then, referring to FIG. 4, retracting the first plate 42 to separate it from the second plate 44, and turn on a vacuum there-between, generating a plurality of vacuum spaces between the second surface of the flexible membrane 46 and the semiconductor wafer 48 under the apertures 442 of the second plate 44, thereby providing vacuum-chucking for the semiconductor wafer 48 to complete loading. Next, polishing the semiconductor wafer 48, as shown in step 60 to step 65, the wafer carrier assembly 40 is moved unto a polishing platen (not shown). The vacuum between the first plate 42 and the second plate 44 is then released and both of them recombine together to form a flat plate without through-holes existing therein contacting the first surface of the flexible membrane 46, referring to FIG. 6. Applying a down force on the first plate 42 and rotating the wafer carrier assembly 40 or the polishing platen (not shown) to perform the chemical mechanical polishing process for the semiconductor wafer 48.

In accordance with the foregoing, during the polishing process, the first plate 42 and the second plate 44 recombine together to form the flat plate, and hence there are not evacuated openings located above the polishing surface of the semiconductor wafer 48 to adversely influence local uniformity of the polishing surface. Besides, the global uniformity of the polishing surface of the semiconductor wafer 48 is improved through the flexible membrane 46.

The preferred embodiments are only used to illustrate the present invention, not intended to limit the scope thereof. Many modifications of the preferred embodiments can be made without departing from the spirit of the present invention.

What is claimed is:

1. A wafer carrier assembly for a chemical mechanical polishing apparatus, comprising:

a first plate having a plurality of protrusions formed on a surface thereof;

a second plate located under said first plate and having a plurality of apertures passing through, each of said apertures matched with one of said protrusions of said first plate to enable said first plate and said second plate to detachably combine together; and a flexible membrane positioned under said second plate, a first surface of said flexible membrane contacting a surface of said second plate and a second surface of said flexible membrane opposite said first surface providing a wafer-receiving surface;

wherein when said first plate is separated from said second plate and a vacuum is turn on there-between, a plurality of vacuum spaces are formed under said second surface of said flexible membrane beneath said apertures of said second plate to provide vacuum-chucking for a semiconductor wafer.

2. The wafer carrier assembly of claim 1, wherein a first supporting film is attached unto a surface facing downward of each of said protrusions of said first plate.

3. The wafer carrier assembly of claim 1, wherein a second supporting film is attached unto said surface of said second plate contacting said first surface of said flexible membrane.

4. The wafer carrier assembly of claim 1, wherein said protrusion of said first plate is nipple-shaped to make said first plate provided with a wedge-shaped surface.

5. The wafer carrier assembly of claim 4, wherein a third supporting film is attached unto a surface of said nipple-shaped protrusion facing downward.

6. The wafer carrier assembly of claim 4, wherein said protrusions are integrally formed with said first plate.

7. The wafer carrier assembly of claim 1, wherein said protrusions are integrally formed with said first plate.

8. The wafer carrier assembly of claim 1, wherein said first plate is circular-shaped.

9. The wafer carrier assembly of claim 1, wherein said second plate is circular-shaped.

10. The wafer carrier assembly of claim 1, wherein said flexible membrane is U-shaped.

11. The wafer carrier assembly of claim 1, wherein said first plate is made of stainless steel.

12. The wafer carrier assembly of claim 1, wherein said first plate is made of a material with hardness at least about 30RB.

13. The wafer carrier assembly of claim 1, wherein said second plate is made of stainless steel.

14. The wafer carrier assembly of claim 1, wherein said second plate is made of a material with hardness at least about 30RB.

* * * * *